US005562281A

United States Patent [19]

Honda et al.

[11] Patent Number: 5,562,281

[45] Date of Patent: Oct. 8, 1996

[54] LEADING END STACKED POSITION REGULATING APPARATUS IN THIN SHEET MATERIAL STACKER

[75] Inventors: Noriyuki Honda; Yukio Abe, both of Obu; Yoshioki Nozawa, Nishio; Makoto Isobe, Aichi, all of Japan

[73] Assignee: Meinan Machinery Works, Inc., Obu, Japan

[21] Appl. No.: 338,784

[22] Filed: Nov. 9, 1994

[30] Foreign Application Priority Data

Nov. 25, 1993 [JP] Japan ..... 5-318952
Dec. 9, 1993 [JP] Japan ..... 5-341521

[51] Int. Cl.[6] ..... B65H 29/54

[52] U.S. Cl. ..... 271/308; 271/180; 271/182; 271/220; 271/900; 414/789.1; 414/794.7

[58] Field of Search ..... 414/789.1, 794.7; 271/18.3, 307, 308, 312, 180, 188, 189, 204, 220, 221, 900, 193, 197

[56] References Cited

U.S. PATENT DOCUMENTS 2,785,894 3/1957 Reinartz ..... 271/189
3,273,726 9/1966 Buccicione .
4,905,979 3/1990 Limbach et al. ..... 271/189
5,201,513 4/1993 Mion ..... 271/180

FOREIGN PATENT DOCUMENTS 51-20108 6/1976 Japan .
0018669 1/1986 Japan ..... 271/189

*Primary Examiner*—H. Grant Skaggs
*Attorney, Agent, or Firm*—Armstrong, Westerman, Hattori, McLeland & Naughton

[57] ABSTRACT

An apparatus for regulating a leading end stacked position in a stacker for successively stacking thin sheet materials. The apparatus for regulating leading end stacked positions of thin sheet materials which are introduced into a thin sheet material stacker at high speeds, and are dropped and stacked one upon another, comprises: a retractable damping ruler normally standing by at a stand-by position upstream of a predetermined leading end stacking position, and adapted to preferentially abut the leading end of a thin sheet material each time when the thin sheet material introduced into the stacker is obliquely dropped and then retracted; a stationary ruler always located at the predetermined leading end stacking position, and adapted to finally abut the leading end of the thin sheet material, in place of the damping ruler which is retracted in association with abutting thereof against the thin sheet material; and a restoring mechanism for returning the damping ruler to the stand-by position each time when the sheet material is dropped below the damping ruler.

4 Claims, 6 Drawing Sheets

LEADING END STACKED POSITION REGULATING APPARATUS IN THIN SHEET MATERIAL STACKER

BACKGROUND OF THE INVENTION

1. Field of the Invention

The present invention relates to an apparatus for regulating a leading end stacked position in a stacker for successively stacking thin sheet materials.

2. Description of the Related Art

Conventionally, as an example of stackers for successively stacking sheet-like articles one upon another, the one of a type in which sheet-like articles are successively introduced by means of various kinds of conveyers such as a stab conveyer, a suction conveyer and the like, into a stacker body, and then, they are forcibly or freely dropped obliquely and stacked one upon another, allowing the sheet-like articles to directly abut, at their leading ends, against a stationary ruler located at a predetermined leading end stacking position, so as to regulate the leading end stacked positions of the stacked sheet-like articles at a substantially uniform position has been well-known and it has an extremely simple structure, having a reasonable degree of stacking efficiency.

However, a sheet-like material can directly abut the stationary ruler, provided that stiff plate-like articles such as plywood or synthetic resin plates are introduced at low speeds into a stacker. Should plate-like articles or the like which are even stiff more or less be introduced into the stacker at high speeds, or should weak sheet materials as the plate-like articles be introduced into the stacker (the conveyance of veneers in a direction perpendicular to the fiber thereof can be exemplified), a fatal problem such as damage to the leading end of a plate-like article or buckling of the intermediate part thereof would be likely to occur. Accordingly, it is difficult to stack the weak plate-like articles one upon another with the use of the above-mentioned system.

Further, there is another well-known system in which a movable ruler that is held by a resilient member such as a spring so as to be resiliently displaceable, instead of the stationary ruler in the above-mentioned system, in order to buffer and absorb a shock caused by impingement of a plate-like article upon the movable ruler through extension and retraction of the spring, and after the plate-like article is once dropped to a position downstream of a predetermined stacking position, the plate-like article is moved again in a direction reverse to the direction of introduction of the plate-like article by the resilient force of the above-mentioned resilient member so as to regulate the leading end stacked positions of plate-like articles which are therefore maintained so as to be substantially uniform. This improved system is excellent in high speed responsiveness, and reduces the possibility of occurrence of a fatal problem caused by an inclination of the posture of a plate-like article upon conveyance, so as to be relatively effective in comparison with the aforementioned embodiment.

However, in order to move again the once dropped plate-like article in a direction reverse to the direction of introduction of the article as mentioned above, it is required to enable the plate-like articles to smoothly slide one upon another. However, if the plate-like articles are weak thin sheet materials, no sufficient force can be transmitted satisfactorily from the front end to the rear end thereof so as to induce a problem such that the front end part or the intermediate part of a thin sheet material to be again moved is buckled. Thus, even with the improved system, it is difficult to stack the sheet materials one upon another. As a result, either the conveyance of the sheet materials has to be once stopped each time when a sheet material is vertically dropped fop stacking by neglecting a decrease in the stacking efficiency, or they are randomly stacked without regulating the positions thereof. However, it has been practically unreasonable either.

SUMMARY OF THE INVENTION

The present invention has been accomplished to improve the above-mentioned conventional apparatus so as to efficiently stack thin sheet materials one upon another, even though they are more or less weak, while the leading end stacked positions of the thin sheet materials are maintained to be substantially aligned. An apparatus according to the present invention for regulating leading end stacked positions of thin sheet materials which are introduced into a thin sheet material stacker at high speeds, and are dropped and stacked one upon another, comprises: a retractable damping ruler normally standing by at a stand-by position upstream of a predetermined leading end stacking position, and adapted to preferentially abut the leading end of a thin sheet material each time when the thin sheet material introduced into the stacker is obliquely dropped and then retracted; a stationary ruler always located at the predetermined leading end stacking position, and adapted to finally abut the leading end of the thin sheet material, in place of the damping ruler which is retracted in association with abutting thereof against the thin sheet material; and a restoring mechanism for returning the damping ruler to the stand-by position each time when the sheet material is dropped below the damping ruler.

BRIEF DESCRIPTION OF THE DRAWINGS

The present invention will be more apparent from the ensuring description with reference to the accompanying drawing wherein:

FIG. 8 is an explanatory view from the upstream side illustrating essential portions when the thin sheet material is located at the position shown in FIG. 2 with a dotted line.

DETAILED DESCRIPTION OF PREFERRED EMBODIMENT

Figure 1:
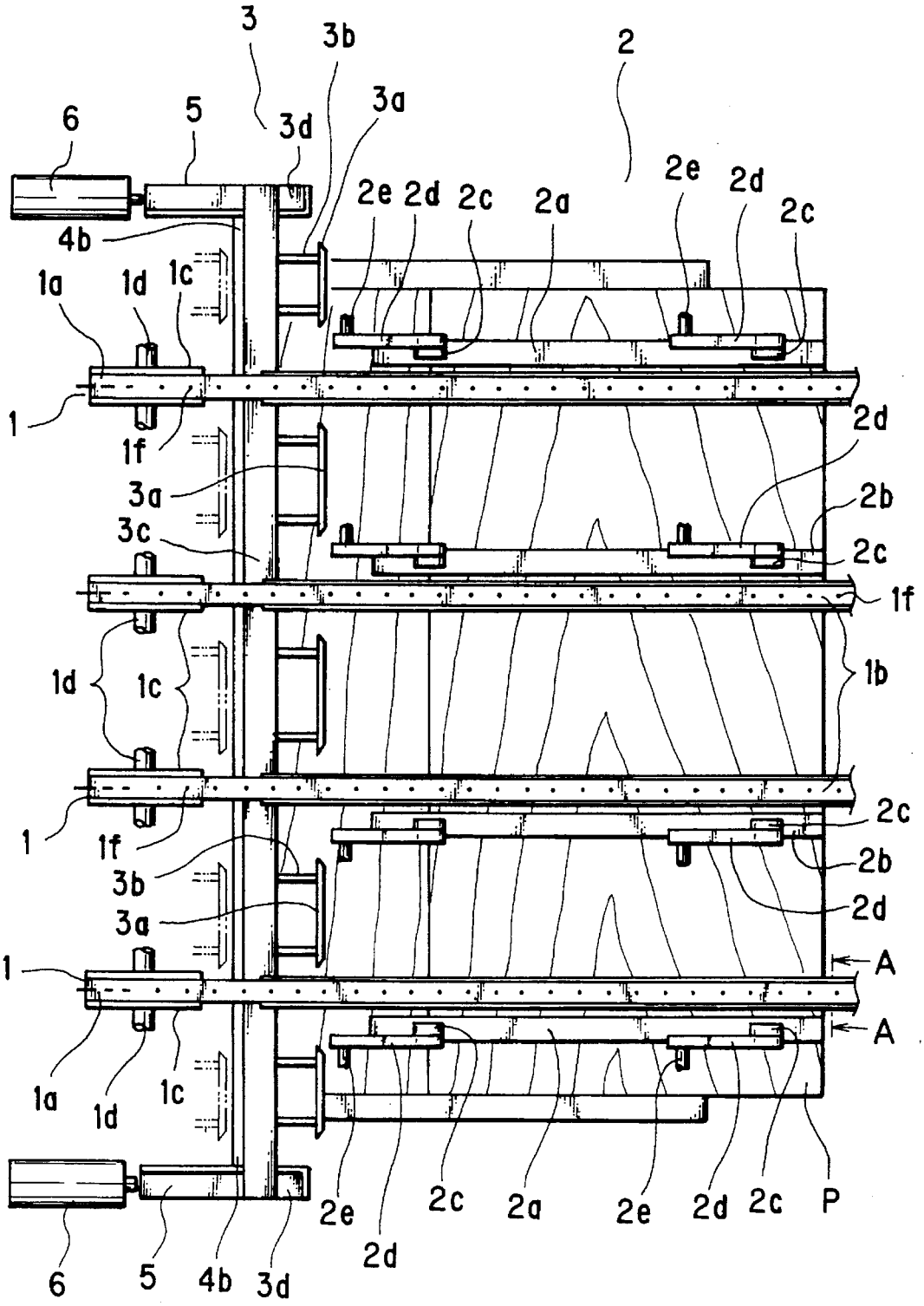
FIG. 1 is an explanatory schematic plan view illustrating a stacker with a regulating apparatus according to the present invention.

A leading end stacked position regulating apparatus in thin sheet material stacker according to an embodiment of the present invention will be explained in detail with reference to drawings. It is noted that a control system for controlling the operation of equipments constituting a stacker has no special configuration but a completely usual configuration, and accordingly, the control system is not shown in the drawings for the sake of convenience.

Figure 2:
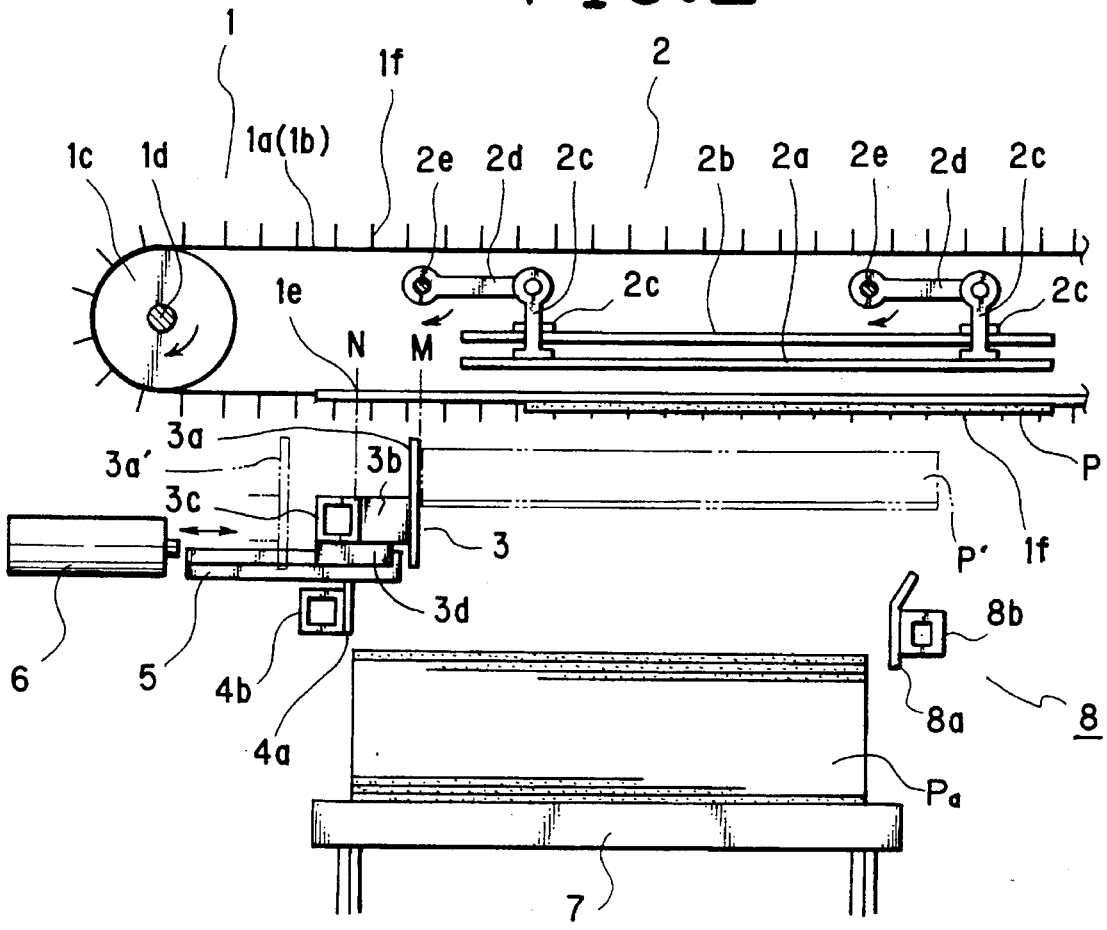
FIG. 2 is an explanatory schematic side view illustrating the stacker shown in FIG. 1.
Figure 3:
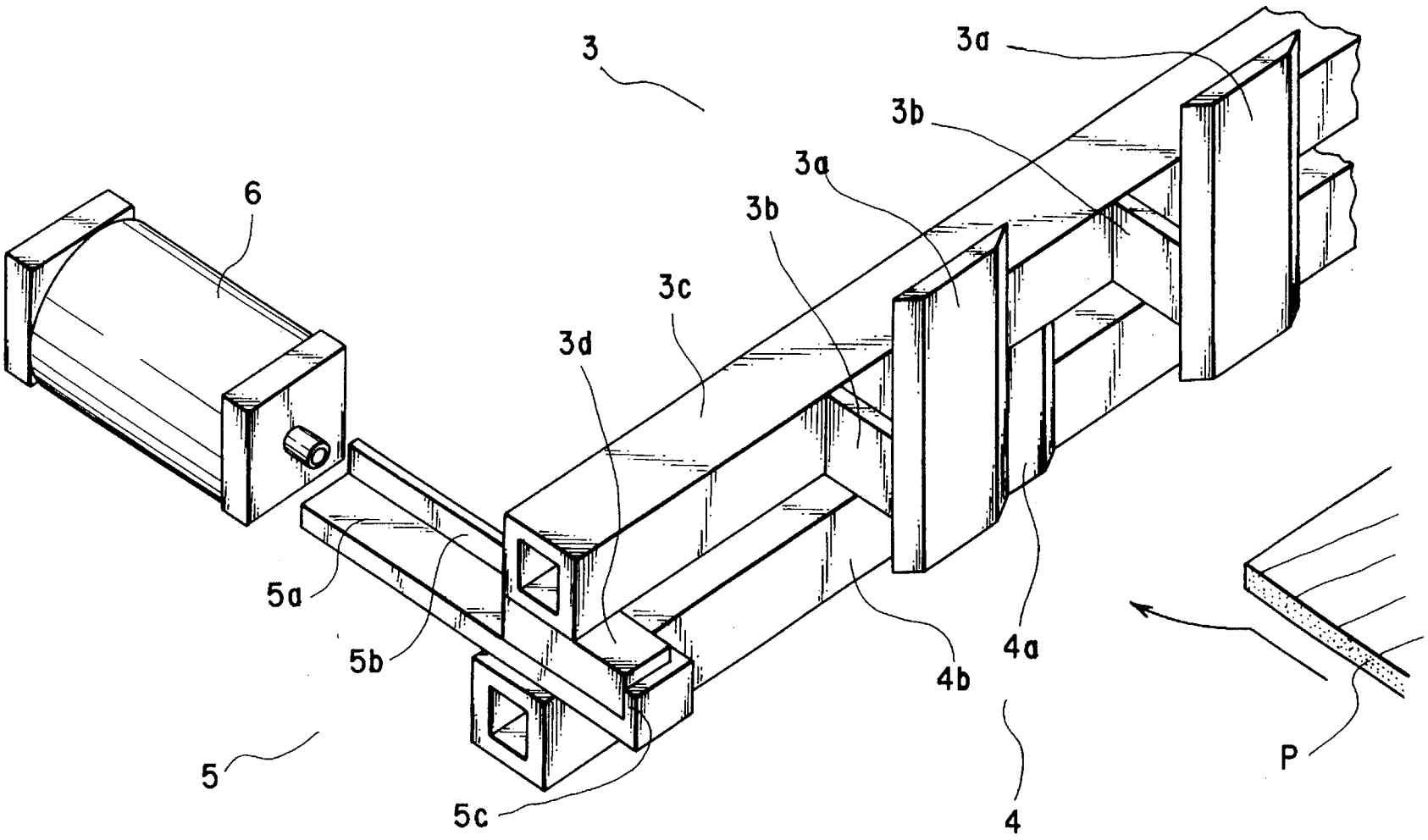
FIG. 3 is an explanatory enlarged perspective view illustrating a part of the stacker exemplified in FIGS. 1 and 2.
Figure 4:
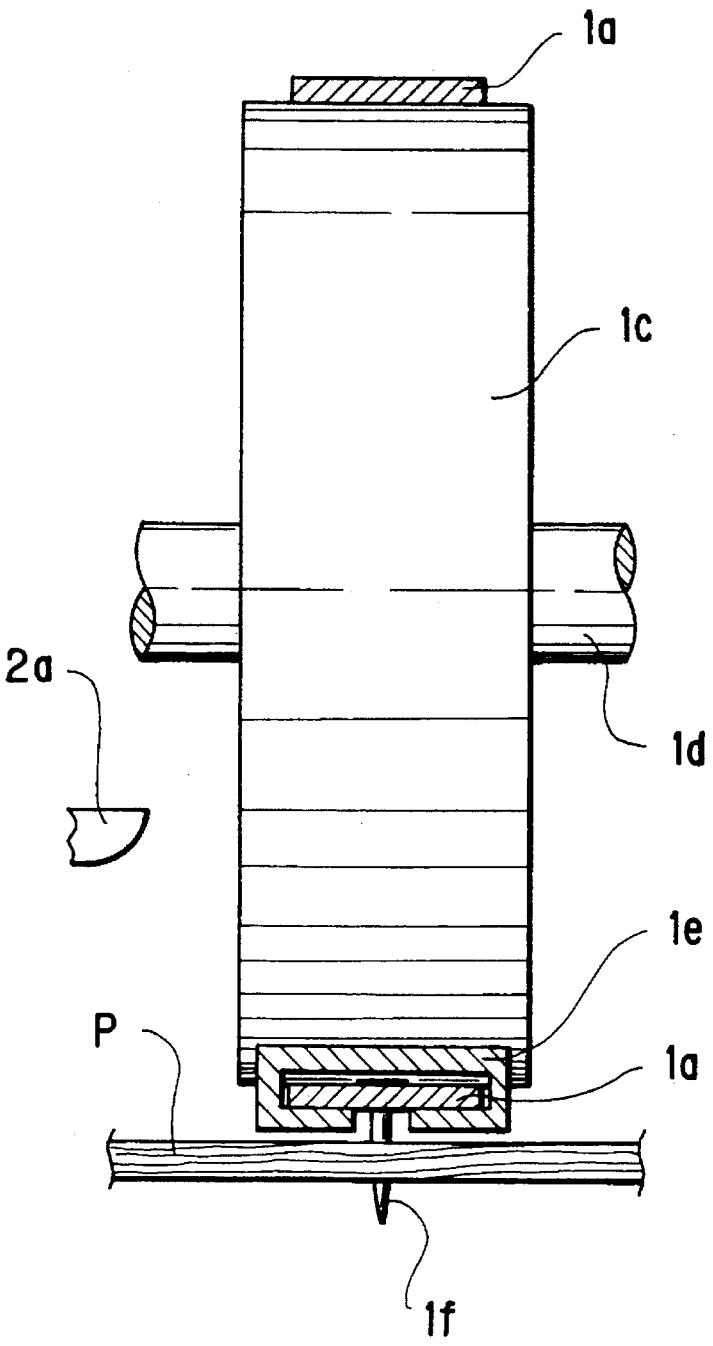
FIG. 4 is a partially enlarged explanatory cross-sectional view taken along the line A—A of FIG. 1.
Figure 5:
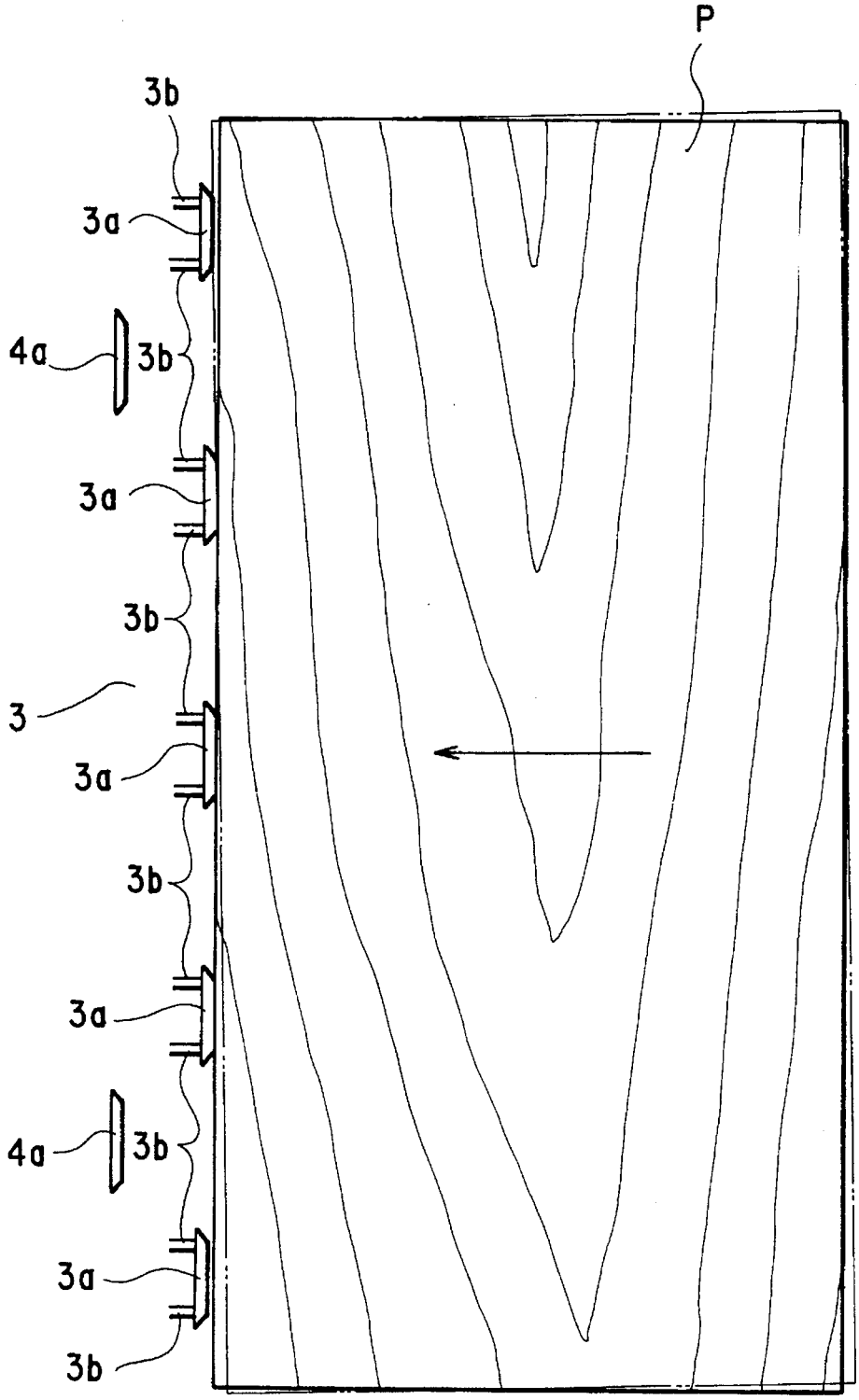
FIG. 5 is an enlarged explanatory plan view of rulers and a thin sheet material when the thin sheet material is located at the position shown in FIG. 2 with a dotted line.

FIG. 1 is an explanatory schematic plan view of a stacker for veneers according to the present invention; FIG. 2 an explanatory schematic side view of the stacker shown in FIG. 1; FIG. 3 an explanatory enlarged perspective view of a part of the stacker shown in FIGS. 1 and 2; FIG. 4 a partially enlarged explanatory cross-sectional view taken along the line A—A of FIG. 1; FIG. 5 an enlarged explanatory plan view of rulers and a veneer when the veneer is located at the position shown in FIG. 2 with a dotted line; and FIG. 6 an explanatory view from the upstream side illustrating essential portions when the veneer is located at the position shown in FIG. 2 with a dotted line.

In the figures, reference numeral 1 denotes a stab conveyor which conveys a rectangular veneer P in a direction perpendicular to a fiber direction thereof and which comprises stab belts 1*a* located near both lateral sides of the veneer P and mounted with a number of nails 1*f*, stab belts 1*b* located near the centerline portion of the veneer P and mounted with a number of nails 1*f*, pulleys 1*c*, driving shafts 1*d*, belts guides 1*e* to maintain the belts 1*a* at a fixed position even when the belts 1*a* are subjected to a force and others. The stab conveyor 1 is driven in the arrow-marked direction at high speeds by a drive source (not shown) such as a motor or the like, and conveys continuously the veneer P which is stabbed from above with the nails 1*f* at the stabbing position upstream of the stacking position to a predetermined station where the stabbed veneer P is released.

Reference numeral 2 denotes a strike-release mechanism to hit and drop the veneer P obliquely downward which comprises strike-release levers 2*a* corresponding to the stab belts 1*a* located near both lateral sides of the veneer P, strike-release levers 2*b* corresponding to the stab belts 1*b* located near the centreline portion of the veneer P, connecting arms 2*c*, pivoting arms 2*d*, driving shafts 2*e* and the like. Based on a start signal from a sheet material detector (not shown) which detects that the veneer 5 has reached the predetermined station by means of the stab conveyor 1 or from an encoder (not shown) which measures a distance of transfer from the stab position, the strike-release mechanism 2 is intermittently driven by a drive source (not shown) such as a servo motor, a motor with a clutch and a brake and the like, and forcibly releases and drops the sheet material P obliquely downward when the veneer P reaches the predetermined station.

Figure 6:
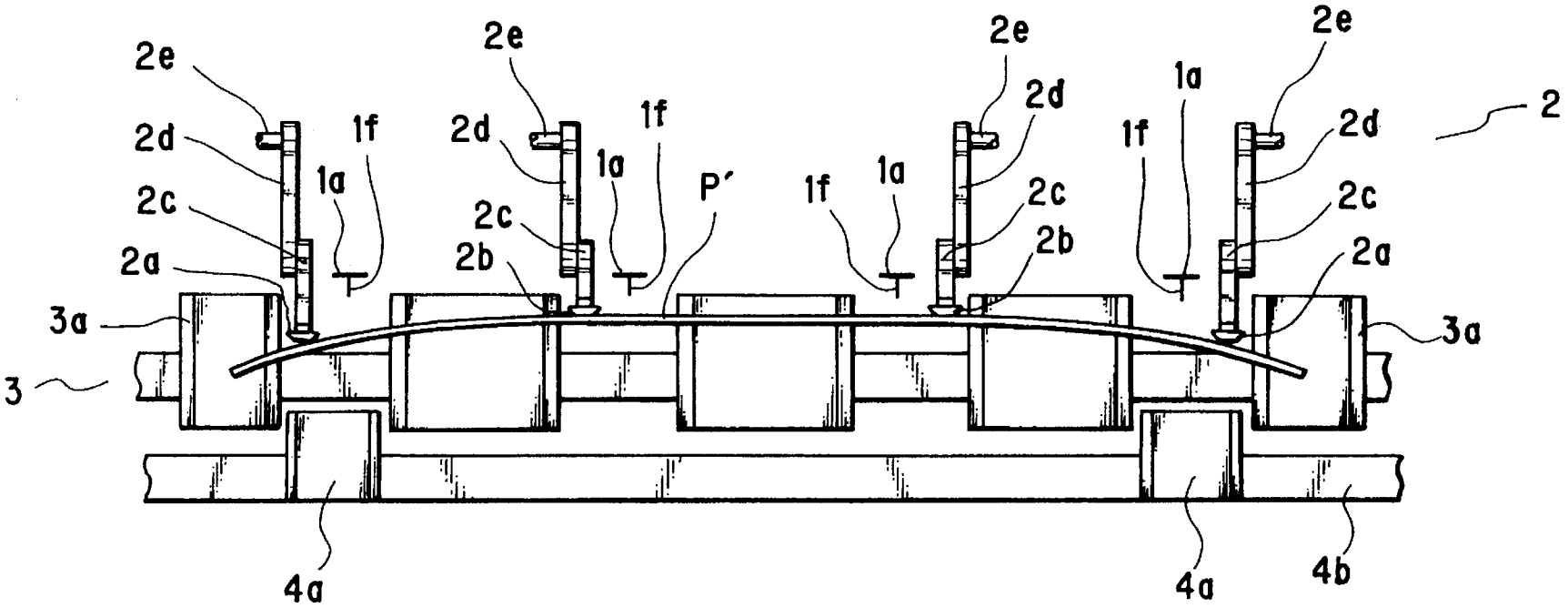

As clearly illustrated in FIGS. 2 and 6, in the strike-release mechanism 2, the bottom position of lowering of strike-release levers 2*a* corresponding to the stab belts 1*a* located near both lateral sides of the veneer P is set lower than the bottom position of lowering of strike-release levers 2*b* corresponding to the stab belts 1*b* located near the centerline portion of the veneer P by differentiating lengths of relevant connecting arms 2*c*.

Reference numeral 3 is a damping ruler having ruler plates 3*a*, supporting plates 3*b*, a slide beam 3*c*, slide guides 3*d* and the like, and is mounted on slide surfaces 5*a* of slide bases 5 in a slidable manner as describe below. Normally, the damping ruler 3 is standing by at the stand-by position M on a path of dropping of the downstream end of the sheet material P. The stand-by position M is located upstream of the predetermined downstream end stacking position N as illustrated with a solid line. The damping ruler 3 retracts to the downstream side as illustrated with a two-dot chain line when abutting the veneer P moving obliquely downward, and is returned again to the stand-by position M through a restoring mechanism, as described below, each time the veneer P drops below the damping ruler 3.

Reference numeral 4 denotes a stationary ruler having regulating plates 4*a*, a stationary beam 4*b* fixed to the frame (not shown) of the stacker and other members. The regulating plates 4*a* are fixed to the stationary beam 4*b* in such a manner as to be positioned on the path of dropping of the downstream end of the veneer P which abuts the ruler plates 3*a* and moves obliquely downward, thereby being always located at the predetermined end stacking position N.

Reference numeral 5 denotes a slide guide also serving as stopper having a slide surface 5*a*, a guide wall 5*b*, a stop wall 5*c* and others, and is fixed to the frame (not shown) of the stacker or the like so that the slide surface 5*a* maintains levelness or substantial levelness. The slide guides also serving as stoppers 5 support the damping ruler 3 in a slidable manner and regulate a return thereof to the stand-by position M uniformly.

Reference numeral 6 denotes a restoring mechanism comprising an air cylinder and others. The restoring mechanism returns the damping ruler 3 to the stand-by position M based on a delay signal or the like which delays quantitatively with respect to the start signal from the strike-release mechanism 2 each time the veneer P drops below the damping ruler 3.

Reference numeral 7 denotes an elevatable stacking bed, which receives the veneers P dropping one after another always at a substantially stationary level under control of a controller (not shown) or the like based on a start signal from a level detector (not shown) which detects the level of the top surface of the stacking bed 7 (top surface of a bottom plate when used as needed) when stacking starts and which detects the level of the top surface of a stack Pa of veneers stacked on the stacking bed 7 after stacking is started.

Reference numeral 8 denotes a stationary guide having guide plates 8*a*, stationary beam 8*b* and the like. Exceptionally, when a preceding veneer P is caught obliquely by the stationary ruler 4 and stacked in the caught state, a succeeding veneer P to be stacked abuts the preceding veneer P, not the stationary ruler 4, and is sprung to the upstream side by elasticity of the preceding veneer P. In such a case, the stationary guide 8 abuts the upstream end of the succeeding veneer P, thereby preventing the veneers P from deviating greatly. The stationary guide 8 is fixed to frames (not shown) of the stacker or the like so as to be opposed to the stationary ruler 4 with a sufficient distance take therebetween in comparison with the length of the veneer P in the direction of conveyance.

Also, as clearly illustrated in FIG. 5, the center part of the damping ruler 3 slightly projects in a direction reverse to the direction that the veneer P is conveyed.

The stacker according to the present invention is constructed, for example, as described above, and the veneer P which is stabbed by nails 1*f* of the stab conveyor 1 and conveyed to the predetermined station is forcibly hit and dropped by the strike-release mechanism 2. Since the veneer P has kinetic energy (inertia), it drops obliquely downward as indicated by P' with a two-dot chain line from the position illustrated with a solid line in FIG. 2.

In this case, as shown in FIG. 6 (the veneer P' is illustrated with a solid line in FIG. 6) which is a view from the upstream side of primary portions of the apparatus when a sheet material is at the position indicated by P' with a two-dot chain line in FIG. 2, the veneer P' drops as being kept in abutment against the strike-release levers 2*a* and 2*b* applied from above, and also drops in an upwardly convexly curved state because the strike-release levers 2*a* are different from the strike-release levers 2*b* in the bottom position of lowering as described above. As a result, the geometrical moment of inertia of the veneer P increases, leading to the state that a strength has improved substantially in the fiber direction and the direction perpendicular thereto; accordingly, the downstream end of the veneer P abuts the ruler plates 3*a* of the damping ruler 3 standing by at the stand-by position M. As a result, this abutment suppresses the occurrence of such phenomena as a damage to the end portion of the veneer P or the buckling of the central portion thereof; accordingly, increasing the speed of conveyance raises no problem with a resultant stacking process at a better efficiency.

On the other hand, when the veneer P abuts the ruler plate 3*a*, the damping ruler 3 retracts as illustrated with a two-dot chain line, while the veneer P exerts a part of kinetic energy owned thereby to the damping ruler 3 and drops further obliquely downward in a decelerated state. Then, the veneer P stalls due to abutment against the regulating plate 4*a* of the stationary ruler 4 of the veneer P and is stacked on the stacking bed 7 or a stack Pa of thin plates with its end stacking position being regulated. Also, each time the veneer P drops below the damping ruler 3, the restoring mechanism 6 returns the damping ruler 3 to the stand-by position M (at least by the time when the next veneer P is hit and dropped).

Similar operations are repeated to stack veneers one after another. In the construction of the regulating apparatus according to the present invention, a veneer exerts a part of kinetic energy owned thereby to the damping ruler which the plate first abuts against, and then abuts the stationary ruler in a decelerated state. Therefore, even when the veneer is somewhat weak, a fatal phenomenon is less likely to occur as compared with the conventional case where the veneer abuts the stationary ruler from the beginning. Accordingly, the veneerm can be introduced at a fairly high speed from the beginning with a resultant efficient stacking work.

As clearly illustrated in FIG. 5, the center part of the damping ruler 3 is slightly projected to the upstream side in the direction of conveyance of the veneer P. Therefore, even when the veneer P is somewhat inclined with respect to the direction of its conveyance as illustrated with a dotted line, a substantially wide portion of the leading end thereof (a portion corresponding to two right-hand ruler plates 3*a* in this embodiment) which ranges from the right hand lateral side end to the centerline portion abuts the damping ruler. As a result, a force imposed on the veneer P at the abutment time is distributed as compared with the case where the ruler plates 3*a* are arranged on a straight line perpendicular to the direction of conveyance of the veneer P, and therefore there arises no problem of damage to the veneer P or the like. Moreover, since the veneer P finally abuts the stationary ruler and an incline thereof is corrected, the posture of stacking does not deteriorate. Needless to say, if the veneer P is not inclined with respect to the direction of its conveyance as illustrated with a solid line, a substantially wide portion near the centerline portion thereof abuts the ruler plates 3*a* in a substantially uniform manner to distribute a force imposed on the veneer P; therefore, it is possible to carry out stacking effectively without any problem.

Further, in the stacker according to the embodiment, since the veneer P is put in an upwardly convexly curved state by the strike-release mechanism 2, the veneer are curved in a fairly remarked manner as needed. However, an excess curve is apt to interfere with the stable settlement of the veneer (at the stacking position) and therefore should be avoided. It is desirable that a preferable degree of curvature be selected based on experiments.

In the aforementioned embodiment, the damping ruler 3 in a single row in the direction of conveyance of the veneer P is used. However, a damping ruler in a multi-row form may be used wherein the damping ruler is divided into a plurality of sub damping rulers in the direction, which sub damping rulers are normally spaced adequately for damping and located at respective stand-by positions. In addition to the form of the aforementioned embodiment wherein the kinetic energy exerted from the veneer P is positively dissipated by a friction force acting on the slide guides 3*d* through the slide surfaces, it may be possible to employ the form wherein the slide guides 3*d* are supported in an easily slidable manner through direct-acting bearings or the like for retracting the slide guides 3*d* substantially frictionlessly at least immediately after abutting the end of a thin plate material. In a word, it is efficient if the damping ruler preferentially abuts against the end of a thin plate material and retracts to change places with the stationary ruler. Design may be modified as appropriate without sticking to the form of the aforementioned embodiment. In any case, if the dead weight of the damping ruler 3 is too heavy or too light, a smooth damping operation cannot be expected; therefore, it is desirable to select the weight based on full-sized experiments. When the dead weight of a sheet material changes periodically, it is desirable to employ adjusting means for making adjustment by adding a weight to or removing from the damping ruler 3.

As for the form of the stationary ruler, it is sufficient if the stationary ruler changes places with the damping ruler to abut the end of a thin plate material and thereby regulating the end stacking position of the thin plate material. Design may be modified as appropriate without sticking to the form of the aforementioned embodiment. However, it is also desirable to select the spacing between the end stacking position where the stationary ruler is located and the stand-by position where the damping ruler is standing by based on experiments.

Moreover, the form of the stacker body is not to be limited to the form of the aforementioned embodiment. In a word, various known forms may be applicable if thin plate materials introduced to a predetermined station by means of various conveyors or the like are dropped obliquely downward and stacked.

In the above embodiment, the turning path type strike-release mechanism is used, and the length of the connecting arm 2*c* is differentiated at appropriate positions, thereby differentiating the bottom position of lowering of a strike-release lever at desired positions. However, even in the case where a strike-release mechanism of the same kind is used, for example, by changing the installation level of the driving shaft 2*e* at appropriate positions, it is possible to differentiate the bottom position of lowering of a strike-release lever as in the above embodiment even when all connecting arms are made identical in length. Also, it is possible to carry out similar setting by using a strike-release mechanism of other type such as a vertical path type. What is essential is that the bottom position of lowering of strike-release levers corresponding to stab belts located near both lateral sides of a sheet material is set lower than the bottom position of lowering of strike-release levers corresponding to stab belts located near the centerline portion of the sheet material. There are no special restrictions on the type of the strike-release mechanism itself.

With the arrangement stated above in which a thin sheet material exerts a part of energy owned thereby to the damping ruler against which it abuts so that it impinges upon the stationary ruler in a decelerated condition, the above-mentioned fatal problem can hardly occur even though it is more or less, weak, and accordingly, thin sheet materials can be introduced at relatively high speeds with no hindrance, thereby it is possible to perform efficient stacking thereof.

Further, even though a thin sheet material is slightly inclined in the direction of conveyance, at least a part of one side of the section of the thin sheet material extending from the leading end to the middle thereof makes contact with the damping ruler in a substantially uniform condition, and accordingly, the load is dispersed so that the possibility of occurrence of the fatal problem due to the concentration of load to a narrow part thereof, caused in the conventional apparatus, can be reduced, and further, the inclination of a thin sheet material can be compensated for, there is no risk of deterioration of the stacked postures of sheet materials. Needless to say, a sheet material which is not uniformly inclined in the direction of conveyance, a part of the middle section thereof solely abuts the damping ruler in a substantially uniform condition so that the load is dispersed, thereby it is also possible to effectively stack thin sheet materials one upon another without hindrance.

As clearly understood from the above, with the use of the regulating apparatus according to the present invention, sheet materials which are even more or less weak can be efficiently stacked one upon another while the leading end stacked positions thereof can be regulated in a substantially uniform condition, and the leading end stacked positions can be reasonably and smoothly regulated even though the leading end of a sheet material is slightly inclined in the direction of conveyance, and accordingly, the applicability to the existing process is excellent, and technical effects and advantages in the application to a process of stacking sheet materials can be remarkable.

What is claimed is:

1. An apparatus for regulating leading end stacked positions of thin sheet materials which are introduced into a thin sheet material stacker at high speeds, and are dropped and stacked one upon another, comprising:

a slide guided retractable damping ruler normally standing by at a stand-by position upstream of a predetermined leading end stacking position, for abutting the leading end of a thin sheet material to receive a force therefrom in a direction of the introduction of said thin sheet material each time the thin sheet material introduced into the stacker is obliquely dropped and to be then retracted;

a stationary ruler located at said predetermined leading end stacking position, for abutting the leading end of the thin sheet material, in place of said retractable damping ruler which is retracted; and a restoring mechanism for returning said damping ruler to said stand-by position each time the sheet material is dropped below said damping ruler.

2. The apparatus for regulating leading end stacked positions of thin sheet materials as claimed in claim 1, wherein center part of said damping ruler slightly projects in a direction reverse to a direction in which the thin sheet material is introduced.

3. The apparatus for regulating leading end stacked position of thin sheet materials as claimed in claim 1, further comprising a strike-release mechanism with strike-release levers to hit the thin sheet material from above and drop it, wherein strike-release levers located near opposite lateral sides of the thin sheet material are set lower than strike-release levers located near a centerline portion of the thin sheet material thereof, whereby said thin sheet material drops and abuts said retractable damping ruler in an upwardly convexly curved state.

4. An apparatus for regulating downstream end stacked positions of thin sheet materials which are introduced into a thin sheet material stacker at high speeds, and are dropped and stacked one upon another, comprising:

a slide guided retractable damping ruler normally standing by on a path of dropping of the downstream end of the thin sheet material, and adapted to abut said downstream end to receive a force therefrom in a direction of the introduction of said thin sheet material and then retract;

a stationary ruler located on a path of dropping in abutment against said damping ruler; and a restoring mechanism for returning said damping ruler to said stand-by position each time the thin sheet material is dropped below said damping ruler.

* * * * *